United States Patent [19]

Mathis

[11] 3,995,389

[45] Dec. 7, 1976

[54] REFERENCE INDEX SYSTEM

[76] Inventor: Tracy L. Mathis, P.O. Box 1425, Wickenburg, Ariz. 85358

[22] Filed: June 6, 1975

[21] Appl. No.: 584,364

[52] U.S. Cl. ..... 40/360; 283/42

[51] Int. Cl.[2] ..... B42F 21/00

[58] Field of Search ..... 283/36–43; 40/359, 360

[56] References Cited

UNITED STATES PATENTS

| | | | |
|---|---|---|---|
| 494,466 | 3/1893 | Dennick | 283/41 |
| 561,888 | 6/1896 | Hon | 283/39 |

FOREIGN PATENTS OR APPLICATIONS

| | | | |
|---|---|---|---|
| 450,832 | 1/1913 | France | 283/42 |
| 268,550 | 9/1950 | Switzerland | 283/42 |

*Primary Examiner*—Louis G. Mancene
*Assistant Examiner*—John H. Wolff
*Attorney, Agent, or Firm*—Drummond, Nelson & Ptak

[57] ABSTRACT

A reference system index system for locating information compiled and arranged in alphabetical sequence such as dictionaries is disclosed. Key numbers are assigned to individual letters of the alphabet or to combinations of letters and appear on a guide page. Indicia are carried at a prominent location such as on the page edge of the dictionary so that a person can quickly locate the desired section by use of the key reference numerals.

3 Claims, 4 Drawing Figures

REFERENCE INDEX SYSTEM

The present invention relates to a reference index system and more particularly relates to a numerical index system for use in association with dictionaries and the like.

Various index systems for use with records and reference works are presently available. These systems facilitate use of reference works in order that the user may expeditiously locate the information that is sought. In addition, various reference systems are used as teaching aids to assist pupils in learning use of information sources. One of the most common index systems is that associated with conventional dictionaries. In this system the page edge of the book is notched sequentially at each alphabetical section. The user can locate the section of the book which contains words beginning with a particular letter. This system is convenient and handy to use for the more advanced user. However, beginners such as primary level users have some difficulty with this system as it requires a basic knowledge of alphabetical sequencing. To use this system, the student must know the approximate location of the beginning letter of the word within the alphabet.

Another system of this general type is that used by *Roget's International Thesaurus*. The *Roget's* system comprehends a numbered section setting forth synonyms and associated words. The *Roget's* system is not an alphabetical system and is not a dictionary system in which a word meaning can be located. With *Roget's* system the located numbered section sets forth synonyms and associated words.

Various index systems are also disclosed in prior art patents. For example, U.S. Pat. No. 494,466 to Dennick, discloses a record book index specifically designed for use with county records of deeds, mortgages and the like. The entries under each letter are broken down and carry a corresponding numeral indicating a page of the index book in which the name is to be found. The Dennick system is not a teaching tool and is not compatible with dictionary systems. The Dennick system is primarily a record index and would have little application as an educational device.

The present invention comprehends an index system which has application as a convenient reference system and as a teaching tool. As a teaching tool, the system of the invention enables beginning pupils to quickly familiarize themselves with the alphabet and dictionary systems. As an index system, it facilitates quick and convenient location of information by the user.

Briefly, the present invention comprehends an index system in which key reference numerals are assigned to individual letters of the alphabet or combinations of letters of the alphabet. This reference notation is carried as indicia at a prominent location on the reference work such as on a title page of a dictionary. A person wishing to quickly locate the section of the dictionary containing words beginning with a particular letter, would note that these words are found at the index corresponding to a particular numeral. The advantage of this is that the user can quickly find the proper section of the work by numeral without having to mentally determine location of the first letter of the word within the alphabet. As pointed out, the concept may be carried further and section numbers could be assigned to common word groupings such as commonly used word prefixes.

A more complete understanding of the present invention will be had from the following specification, claims and drawings in which:

Figure 1:
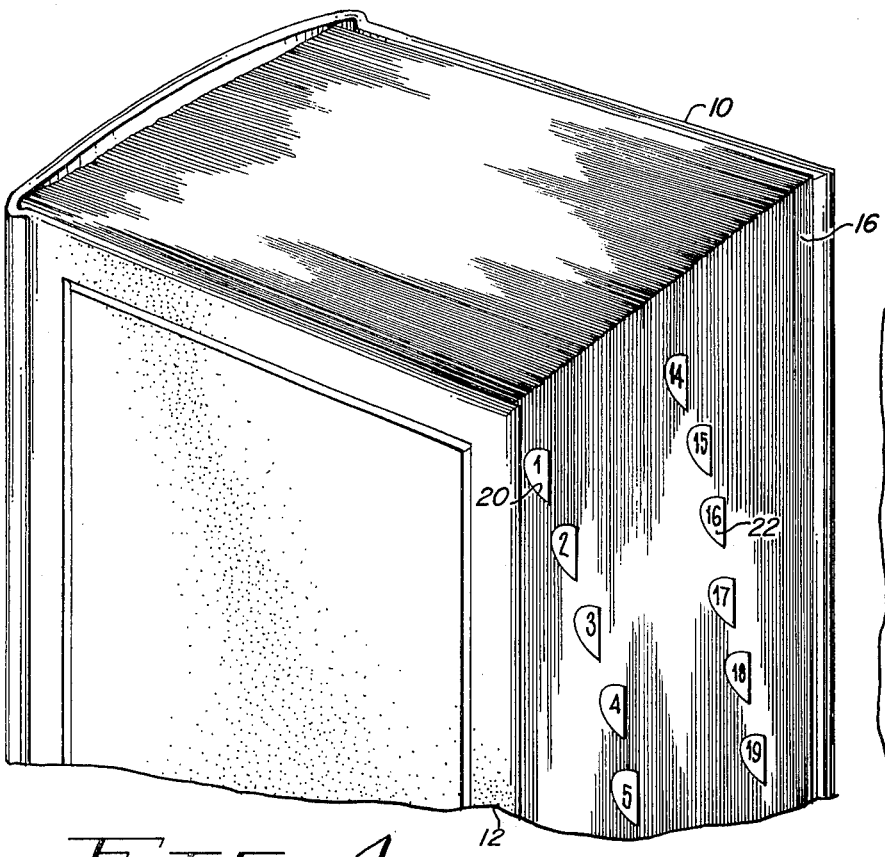
FIG. 1 is a perspective view of a portion of a dictionary incorporating the reference system of the present invention.

Referring now to FIG. 1, the index system of the present invention is shown in accordance with a dictionary indicated by the numeral 10. While the system of the present invention will be described with reference to a dictionary for purposes of illustration, it will be understood that it can be used with other types of works in which information is arranged in an alphabetized sequence such as telephone directories, encyclopedias and various other compilations and reference works. Dictionary 10 is more or less conventional having a cover 12 enclosing a series of bound pages 16. The individual pages 16 set forth words alphabetically arranged along with information about their forms, pronunciations, functions and etymologies, meanings and syntactical and idiomatic uses. The exposed right-hand edge of the pages 16 are notched at 20. Each notch exposes a portion of a page containing words beginning with a particular letter. The exposed portion of the page at the bottom of a notch bears an indicia number 22 from 1 to 26. These numbers serve as indicia and are arranged sequentially beginning with the number 1 in the upper position and decending in order through the number 26. For convenience, the numerical indicia are shown arranged in two rows. Each of the numbers corresponds to a letter of the alphabet as will be explained.

Figure 2:
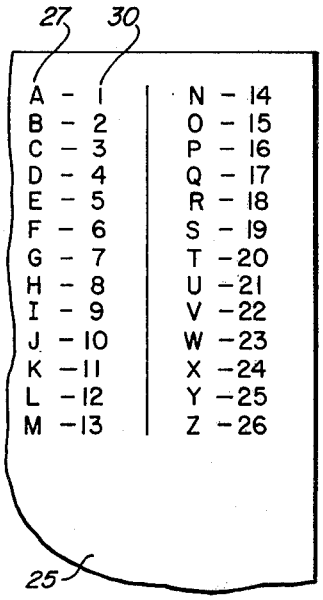
FIG. 2 illustrates the guide index page of the dictionary shown in FIG. 1.

Referring to FIG. 2, the title sheet or use guide 25 is reproduced. This sheet serves to correlate the indicia numbers 22 and is located at a prominent location in the book. Sheet 25 may occupy a position on the front cover of book 10 or be located on the inside cover or as an initial page. Guide sheet 25 sets forth a list 27 of letters A through Z in columnar form. A corresponding column of key numbers 1 through 26, identified by the numeral 30, are arranged correspondingly with alphabet column 27. It will be seen that each of the letters of the alphabet can be directly correlated to a key number. For example, the letter M corresponds to the numeral 13, the letter B to the numeral 2, and so on. This number serves as the key to the use of the system and the appropriate section is located by reference to indicia numbers 22 on the book.

A more complete understanding of the present invention will be had from the following description of use. When the user wishes to locate a particular word, reference is first made to use or guide sheet 25. As pointed out above, the guide sheet will be conveniently located in book 10 for ready reference. Should the user wish to obtain information concerning the word "colosynth" reference is made to guide sheet 25. From guide sheet 25 it is determined that letter "C" corresponds to the key numeral 3. Accordingly, the user would simply locate section number 3 at the appropriate indicia location 22 on the edge of the dictionary. By turning to this section the user can then proceed in alphabetical order to find the word and obtain the required information.

It is also preferable that the pages within various alphabetized sections carry their corresponding numerals. In this way, the user can easily and with facility locate the appropriate alphabetical sections. Young users at the learning stage will find this particularly helpful since it is also difficult for the beginner to determine the location within the alphabet of a particular letter.

Once the user is able to determine that the words beginning with a particular letter are in a particular location and isolate that location, the use of the dictionary is simplified. Further use of this system will familiarize users with the alphabet to the extent that they can easily use conventional dictionaries. In this regard, the system of the present invention is a helpful teaching and educational device.

Figure 3:
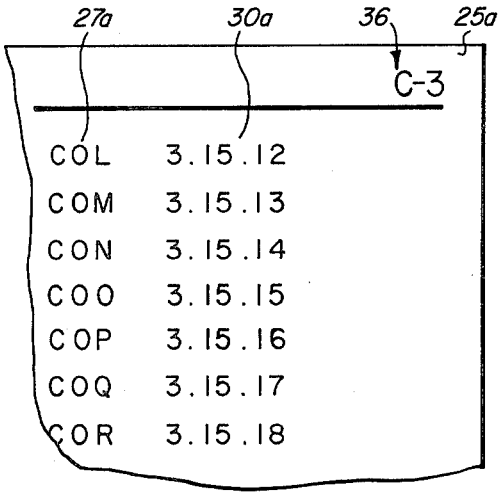
FIG. 3 illustrates a portion of a guide or index page illustrating another embodiment of the present invention in which common word prefixes are assigned section sub-numbers.
Figure 4:
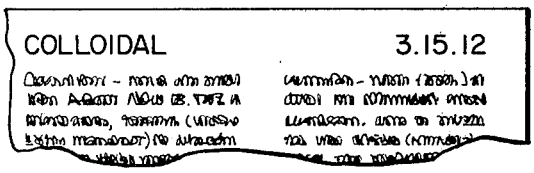
FIG. 4 illustrates a portion of a dictionary page corresponding to the guide page of FIG. 3.

Another form of the present invention is shown in FIGS. 3 and 4. In FIG. 3, a portion of a use or guide sheet 25A is shown. Guide sheet 25A is similar to guide sheet 25 shown in FIG. 2; however, in addition to each letter being assigned a corresponding numeral, subdivisions are provided. Throughout the views identical numerals have been used to represent the same or similar elements with letters appended for clarity. Column 27A lists common word prefixes in alphabetical order and column 30A sets forth corresponding numerical key numbers. For example, from page heading 36 it is seen that the words beginning with the letter "C" are all found in index section 3. Further, sub-divisions are provided with common prefixes such as "con", "com", etc., having assigned key numerals 30A. For example, referring to guide sheet 25 the index numeral 3.15 is assigned to prefixes of words beginning "Co". This will further assist the user in locating appropriate words. If the user is seeking the word "colloidal", it will be observed that "Col" words are at section 3.15.12. By locating section 3 on the appropriate indicia 22 of the dictionary, the general alphabetical division is located. The user then proceeds within section 3 until sub-section 3.15.12 is located. The words beginning "Col" are within this section and the particular word can easily be located.

From the foregoing it will be seen that the present invention provides a unique and novel index system which can be used with a wide variety of informational words. The invention is particularly applicable to dictionaries and, as pointed out above, facilitates use by the experienced user and also serves as an educational and learning tool for the beginner.

It will be obvious to those skilled in the art to make various changes, alterations and modifications to the device of the present invention. To the extent that these changes, alterations and modifications do not depart from the spirit and scope of the appended claims, they are intended to be encompassed therein.

I claim:

1. A reference index and teaching tool enabling the beginning user to efficiently locate information compiled and arranged in sections in a book such as a dictionary, each separate section of the book containing information grouped according to separate letters within the alphabet, said system comprising:

a. guide means located on an exposed portion of said book for convenient reference, said guide means consisting of a list of the alphabetical sections contained within the book and a key numeral counterpart for each of the alphabetical sections, said key numerals being in seriatim arrangement and a distinct key numeral serving as a common identifier for each entire alphabetical section; and b. indicia means associated with each alphabetical section in the book, said indicia means identifying the key numeral counterpart of the alphabetical sections, each page within a section carrying the key numeral common identifier for that section, whereby a particular alphabetical section can be located by the beginning user first locating the appropriate key numeral for an alphabetical section on the guide means and then finding that key numeral on the indicia means to locate the desired alphabetical section.

2. The reference index system of claim 1 wherein said reference system is applied to a dictionary and wherein said indicia means are carried on the edge of the pages.

3. The reference system of claim 1 wherein each letter of the alphabet carries a key number and wherein common alphabetical combinations are assigned subnumbers within the key number.

* * * * *